US005697349A

United States Patent [19]

Blum

[11] Patent Number: 5,697,349

[45] Date of Patent: Dec. 16, 1997

[54] BLOWBY MIST SEPARATOR AND REGULATOR SYSTEM FOR AN ENCLOSED CRANKCASE

[75] Inventor: Randall B. Blum, Peoria, Ill.

[73] Assignee: Caterpillar Inc., Peoria, Ill.

[21] Appl. No.: 759,910

[22] Filed: Dec. 4, 1996

[51] Int. Cl.[6] ..... F02M 25/06

[52] U.S. Cl. ..... 123/572

[58] Field of Search ..... 123/572, 573, 123/574, 41.86

[56] References Cited

U.S. PATENT DOCUMENTS

| | | | |
|---|---|---|---|
| 2,450,864 | 10/1948 | Callaway et al. . | |
| 2,652,819 | 9/1953 | Nusbaum . | |
| 2,737,935 | 3/1956 | Olson . | |
| 3,145,697 | 8/1964 | Barr et al. . | |
| 3,225,753 | 12/1965 | Bintz . | |
| 3,246,639 | 4/1966 | Oliver | 123/572 |
| 3,620,197 | 11/1971 | Albright . | |
| 3,659,625 | 5/1972 | Coiner et al. . | |
| 3,877,451 | 4/1975 | Lipscomb | 123/572 |
| 4,114,576 | 9/1978 | Goto et al. . | |
| 4,167,164 | 9/1979 | Bachmann . | |
| 4,373,499 | 2/1983 | Bendig | 123/572 |
| 4,627,406 | 12/1986 | Namiki et al. | 123/572 |
| 5,090,393 | 2/1992 | Holch | 123/574 |
| 5,347,973 | 9/1994 | Walker, Jr. | 123/574 |
| 5,542,401 | 8/1996 | Newarski | 123/572 |
| 5,564,401 | 10/1996 | Dickson | 123/572 |

OTHER PUBLICATIONS

Mann Crankcase Breather Valve, Filterwerk Mann & Hummel GMBH Dec. 7, 1989.

*Primary Examiner*—Marguerite McMahon
*Attorney, Agent, or Firm*—Fred J. Baehr

[57] ABSTRACT

A blowby mist separator and regulator system for an enclosed crankcase of an internal combustion engine having a submicron mist separator and vacuum regulating valve disposed in a horizontally oriented cylindrical housing connected in fluid communication with the crankcase and an air intake manifold to maintain a vacuum within the crankcase, continuously return separated coalesced mist to the crankcase and prevent cylinder blowby from escaping to the atmosphere and having a pressure sensor in the crankcase, which cooperates with a high pressure indicator to indicate when the pressure within the crankcase becomes positive and blowby gases could be released into the atmosphere if the mist separator is not replaced.

10 Claims, 2 Drawing Sheets

BLOWBY MIST SEPARATOR AND REGULATOR SYSTEM FOR AN ENCLOSED CRANKCASE

TECHNICAL FIELD

The invention relates to internal combustion engines and more particularly to a blowby mist separator and regulator system for an internal combustion engine with an enclosed crankcase.

BACKGROUND ART

In order to reduce pollution from internal combustion engines, blowby gases from the crankcase have been routed to the intake manifold where they are combined with intake air and burned in the engine along with the fuel. Since pressure between the air cleaner and intake manifold is below atmospheric, a vacuum is created in the crankcase and if the vacuum is too high, dirt will be drawn into the engine crankcase past the crankshaft seals. Therefore, there is a need to limit the vacuum in the crankcase to prevent pulling dirt into the crankcase. U.S. Pat. No. 2,652,819 shows a cylindrical housing with a cylindrical filter connected between a crankcase and an intake manifold to vent the crankcase to the intake air stream and remove oil from the crankcase blowby gases and dump the collected oil from the housing back into the oil sump.

SUMMARY OF THE INVENTION

Among the objects of the invention may be noted the provision of a blowby mist separator and regulator system for an internal combustion engine, which limits the vacuum in the crankcase and continuously returns coalesced oil to the crankcase and indicates if the blowby mist separator becomes blocked. In general, a blowby mist separator and regulator system for an enclosed crankcase of an internal combustion engine, when made in accordance with this invention, comprises an air filter, an inlet manifold and an enclosed crankcase and is characterized by an elongated cylindrical housing having an inlet port disposed adjacent one end of the housing and an outlet port disposed adjacent another end of the housing and in fluid communication with inlet manifold. The inlet port is disposed in fluid communication with the enclosed crankcase and with a diaphragm valve that closes as the pressure within the housing drops, at a predetermined pressure the diaphragm valve shuts off the cylindrical housing from the crankcase. A cylindrical submicron mist separator is disposed within the cylindrical housing and is interposed between the inlet and outlet ports. A drain port is disposed in the lower portion of the cylindrical wall of the housing. A drain conduit provides fluid communication between the crankcase and the drain port. A check valve only allowing liquid to flow between the drain port and the crankcase is cooperatively associated with the conduit, whereby differential pressure between the enclosed crankcase and the inlet manifold draws blowby fluid from the crankcase, maintains a regulated vacuum within the crankcase and passes the blowby fluid through the mist separator removing mist particles which coalesce and drain to the bottom of the housing and back to the crankcase via the drain port and drain conduit to prevent the discharge of mist laden blowby fluid to the atmosphere.

BRIEF DESCRIPTION OF THE DRAWINGS

The invention as set forth in the claims will become more apparent by reading the following detailed description in conjunction with the accompanying drawings, wherein like reference numerals refer to like parts throughout the drawings and in which:

DESCRIPTION OF THE PREFERRED EMBODIMENT

Figure 1:
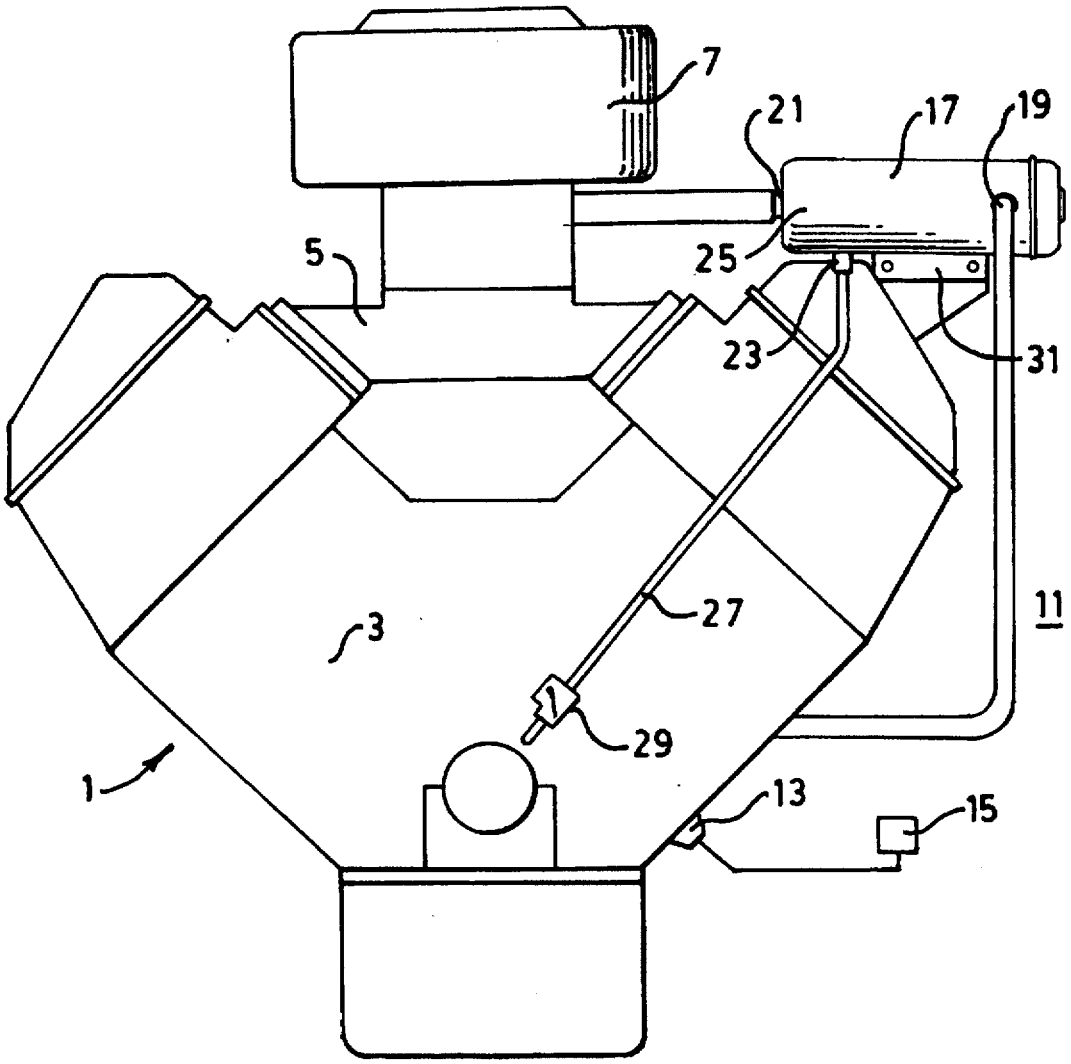
FIG. 1 is a schematic view of an internal combustion engine with a blowby mist separator and regulator system for an enclosed crankcase.

Referring now to the drawings in detail and in particular to FIG. 1 there is shown an internal combustion engine, such as a diesel engine 1, comprising an enclosed crankcase 3, an intake air manifold 5, an air filter 7 and a blowby mist separator and regulator system 11 for the internal combustion engine 1. The blowby mist separator and regulator system 11 comprises a crankcase pressure sensor 13 and a cooperatively associated high pressure indicator 15 and a horizontally oriented cylindrical housing 17. The cylindrical housing 17 has an inlet port 19 disposed adjacent one end, an outlet port 21 disposed adjacent the other end. A drain port 23 is disposed in the lower portion of a cylindrical wall 25 of the housing 17. A drain conduit 27 is disposed in fluid communication with the drain port 23 and is cooperatively associated with a check valve 29 or other means for allowing only liquid to flow between the drain port 23 and the crankcase 3.

Figure 2:
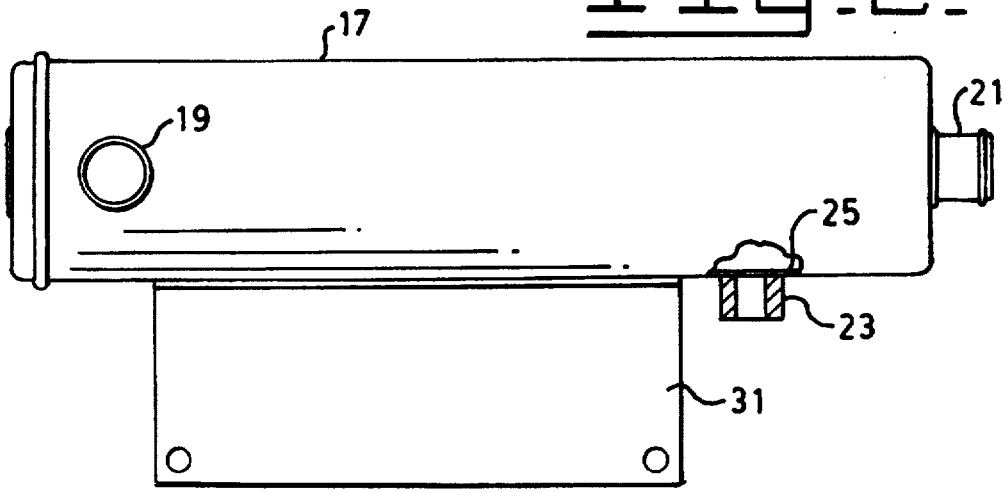
FIG. 2 is an elevational view of the blowby separator and regulator for an enclosed crankcase.
Figure 3:
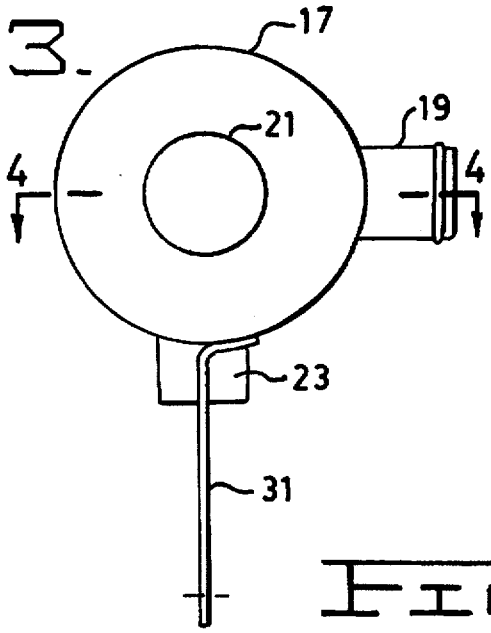
FIG. 3 is a side elevation of the blowby separator and regulator for an enclosed crankcase shown in FIG. 2.

FIGS. 2 and 3 show the orientation and location of the inlet, out and drain ports, 19, 21 and 23, respectively. A mounting plate 31 is shown attached to the lower portion of the cylindrical housing 17 by welding or other means for mounting the housing 17 on the engine 1.

Figure 4:
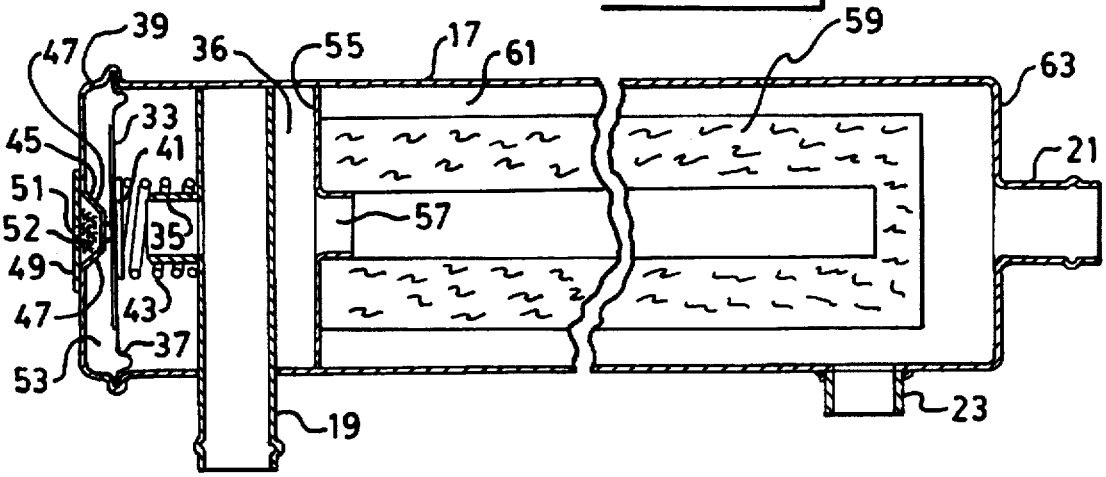
FIG. 4 is an enlarged sectional view taken on line A—A of FIG. 3.

FIG. 4 shows a diaphragm valve 33 disposed within the cylindrical housing 17 and comprising a valve port 35 disposed in fluid communication with the inlet port 19 and the internal area 36 of the housing 17. A flexible diaphragm 37 is affixed in a sealed relationship with the cylindrical wall 25 and an inlet domed head or end 39 of the cylindrical housing 17. A valve closure plate 41 is fastened to the central portion of the diaphragm 37 and is biased away from the valve port 35 by a coil spring 43, which encircles the valve port 33 and engages the valve closure plate 41 adjacent its outer periphery. The inlet domed head 39 has a centrally disposed saucer shaped portion 45 and contains a plurality of vent ports 47. A cover plate 49 with a centrally disposed vent port 51 is fastened in a sealed relationship to the saucer shaped portion 45 to form an enclosure that contains a filter media 52. The vent ports 47 and 51 cooperate to allow clean filtered air at atmospheric pressure to fill a space 53 disposed between the inlet domed head 39 and the diaphragm 37 and to act upon the diaphragm 37.

A support plate 55 is disposed adjacent the inlet port 19 in a sealed relation ship with the cylindrical wall 25 of the cylindrical housing 17 and has a central opening 57. A cylindrical submicron mist separator 59 having an inner diameter generally equal to the inlet port 19, the valve port 35 and the central opening 57 of the support plate 55 and an outer diameter smaller than the inner diameter of the cylindrical housing 17. The cylindrical submicron mist separator 59 is disposed in a sealed relationship with the support plate 55 and is cooperatively associated with the central opening 57 of the support plate 55 so as to direct the blowby fluid into the space confined within the inner diameter of the submicron mist separator 59. The end of the mist separator 59 opposite the support plate is plugged with separator media or an impervious material may be utilized to plug the end of the submicron mist separator 59. Thus, the blowby fluid passes through the cylindrical submicron mist separator 59 from the inside out so that the mist that is coalesced and separated from the blowby gases within the mist separator 59 will be assisted by the outward flow of the blowby fluid to migrate toward the outer periphery of the mist separator 59 and with the aid of gravity will drip from the lower outer periphery of the moisture separator 59, into the bottom of the housing 17, then through the drain port 23 and drain conduit 27. Liquid collects in the drain conduit 27 until the liquid head in the conduit 27 opens the check valve 29 to allow continuously coalesced liquid to flow continuously back into the crankcase 3, while preventing blowby fluid from entering the housing 17 via this route. The outer diameter of the submicron mist separator 59 is sufficiently smaller than the inner diameter of the cylindrical wall 25 to create a circumferential gap 61, sufficiently large to limit the flow velocity of the blowby fluid passing through the circumferential gap 61 to a velocity that will not reentrain liquid droplets of the coalesced liquid formed as they drip from the mist separator 59. The cylindrical submicron mist separator 59 extends longitudinally in the housing 17 a distance less than the distance between the support plate 55 and an outlet domed head 63, which is disposed on the opposite end of the cylindrical housing 17 from the inlet domed head 39. The outlet domed head 63 has the outlet port 21 centrally disposed therein and is disposed in fluid communication with the intake manifold 5 down stream of the air filter 7 to maintain a slight vacuum not in excess of 1.5 inches of water in the enclosed crankcase and prevent the discharge of mist laden blowby fluid to the atmosphere.

The mist separator and regulator system 11 for a typical enclosed crankcase 3 of an internal combustion engine 1 is required to operate at least 10,000 hours and drain coalesced liquid continually during operation, while being generally effective in removing more than 50% of the submicron mist, when the submicron mist separator 59 is fully saturated with coalesced mist. The pressure drop is required to be less than 5 inches of water, when the submicron mist coalescer 59 is saturated and is passing generally twice the normal new engine rated blowby. The regulator portion or diaphragm valve 33 is required to limit the vacuum within the enclosed crankcase 3 to generally less than 1.5 inches of water vacuum and will shut off if the vacuum exceeds 1.5 inches of water. If for some reason the mist separator 59 becomes clogged, the crankcase pressure sensor 13 in the crankcase 3 and crankcase pressure indictor 15 will cooperatively provide a warning signal indicating that the enclosed crankcase 3 is operating under a positive pressurize.

While the preferred embodiments described herein set forth the best mode to practice this invention presently contemplated by the inventor, numerous modifications and adaptations of this invention will be apparent to others skilled in the art. Therefore, the embodiments are to be considered as illustrative and exemplary and it is understood that the claims are intended to cover such modifications and adaptations as they are considered to be within the spirit and scope of this invention.

INDUSTRIAL APPLICABILITY

The blowby mist separator and regulator system 11 for an enclosed crank 3 of an internal combustion 1, herein before described, advantageously provides a reliable efficient system for preventing piston blowby gases from entering the atmosphere, while continually removing entrained submicron lubricating oil from the blowby gases and continually returning the coalesced lubricating oil to the crankcase and provides a system, which is economical to manufacture, maintain and operate.

What is claimed is:

1. A blowby mist separator and regulator system for an enclosed crankcase of an internal combustion engine having an air filter, an inlet manifold and an enclosed crankcase characterized by an elongated cylindrical housing having an inlet port disposed adjacent one end of the housing and an outlet port disposed adjacent another end of the housing and in fluid communication with an inlet manifold, the inlet port being disposed in fluid communication with the enclosed crankcase and with a diaphragm valve that closes as the pressure within the housing drops and at a predetermined negative pressure shuts off the cylindrical housing from the crankcase, a cylindrical submicron mist separator disposed within the cylindrical housing interposed between the inlet and outlet ports, a drain port disposed in the lower portion of the cylindrical housing, a drain conduit providing fluid communication between the crankcase and the drain port, and means for only allowing liquid to flow between the drain port and the crankcase being cooperatively associated with the conduit, whereby differential pressure between the enclosed crankcase and the inlet manifold draws blowby fluid from the crankcase to maintain a regulated vacuum within the crankcase and pass the blowby fluid through the mist separator to coalesce submicron mist and separate out larger mist and drain the coalesced and separated mist to the bottom of the housing and back to the crankcase via the drain port and drain conduit and prevents the discharge of blowby fluid to the atmosphere.

2. The blowby mist separator and regulator system as set forth in claim 1 further characterized by a pressure sensor disposed in the crankcase adapted to provide a pressure signal and is cooperatively associated with a high pressure indicator which indicates that the crankcase is operating at positive pressure and that the mist separator should be replaced.

3. The blowby mist separator and regulator system as set forth in claim 1 further characterized in that the diaphragm valve operates to maintain a vacuum in the crankcase that does not exceed about −1.5 inches of water.

4. The blowby mist separator and regulator system as set forth in claim 1 further characterized in that the submicron mist separator will pass generally two times new engine blowby and remove more than 50% of the submicron mist in the blowby fluid.

5. The blowby mist separator and regulator system as set forth in claim 1 further characterized in that the means for only allowing liquid to flow between the drain port and the crankcase is a check valve which opens when a head of liquid builds up in the drain conduit.

6. The blowby mist separator and regulator system as set forth in claim 1 further characterized in that the outlet port is disposed in fluid communication with an inlet manifold downstream of the air filter.

7. The blowby mist separator and regulator for an enclosed crankcase system as set forth in claim 2 further characterized in that the diaphragm valve operates to maintain a vacuum in the crankcase that does not exceed about −1.5 inches of water.

8. The blowby mist separator and regulator system as set forth in claim 2 further characterized in that the mist separator will pass generally two times new engine blowby and remove more than 50% of the submicron mist in the blowby fluid.

9. The blowby mist separator and regulator system as set forth in claim 2 further characterized in that the means for only allowing liquid to flow between the drain port and the crankcase is a check valve which opens when a head of liquid builds up in the drain conduit.

10. The blowby mist separator and regulator system as set forth in claim 2 further characterized in that the outlet port is disposed in fluid communication with an inlet manifold downstream of the air filter.

* * * * *